US005662518A

United States Patent [19]

James et al.

[11] Patent Number: 5,662,518

[45] Date of Patent: Sep. 2, 1997

[54] PNEUMATICALLY ASSISTED UNIDIRECTIONAL CONFORMAL TOOL

[75] Inventors: Michael D. James, Ft. Gibson; Fritz R. Kruis, Tulsa, both of Okla.

[73] Assignee: Coburn Optical Industries, Inc., Tulsa, Okla.

[21] Appl. No.: 642,351

[22] Filed: May 3, 1996

[51] Int. Cl.[6] ..... B24B 41/06

[52] U.S. Cl. ..... 451/384; 451/41; 451/42

[58] Field of Search ..... 451/41, 42, 43, 451/44, 55, 384, 390

[56] References Cited

U.S. PATENT DOCUMENTS

| | | | |
|---|---|---|---|
| 4,802,309 | 2/1989 | Heynacher | 451/41 |
| 5,520,568 | 5/1996 | Craighead et al. | 451/390 |
| 5,577,950 | 11/1996 | Smith et al. | 451/384 |

*Primary Examiner*—James G. Smith
*Assistant Examiner*—Derris H. Banks
*Attorney, Agent, or Firm*—Frank J. Catalano; Scott R. Zingerman

[57] ABSTRACT

A tool for polishing/fining an ophthalmic lens has a housing with an interior open at planar ends thereof. A cluster of rods is longitudinally aligned in sliding abutment within the housing, each rod of the cluster extending from one planar end of the housing to the other. One resiliently elastic diaphragm extends across one planar end and another resiliently elastic diaphragm extends across the other planar end. A cap has a rim which fixes the exterior perimeter of the first diaphragm against the top of the housing. The cap defines a pneumatic chamber longitudinally aligned between the exterior surface of the first diaphragm and the interior wall of the cap. A passage through the cap wall admits air under pressure into the chamber. A ring fixes the exterior perimeter of the other diaphragm against the bottom of the housing. Screws secure the cap and ring to the housing with the diaphragms therebetween. Pneumatic distortion of one diaphragm is transmitted by longitudinal displacement of individual ones of the cluster of rods to the interior surface of the other diaphragm. This causes the other diaphragm to dynamically comply to the surface of a lens as the other diaphragm and the lens are relatively laterally displaced.

25 Claims, 4 Drawing Sheets

PNEUMATICALLY ASSISTED UNIDIRECTIONAL CONFORMAL TOOL

BACKGROUND OF THE INVENTION

This invention relates generally to the manufacture of ophthalmic lenses and more particularly concerns conformal tools for fining and polishing ophthalmic lenses.

Most known finishing/polishing tools provide a global conformance to the lens, requiring a separate tool for every possible contour of lens. For each lens, the proper tool has to be selected and mounted on the fining/polishing apparatus. With recent development of more accurate lens surfacing equipment, modern lenses exhibit wide variations in face curvature.

While some work has been done in the development of conformal tools which can be used to fine/polish a variety of lenses, little success has been achieved in developing a single or minimal number of fining/polishing tools which will conform to all contours of lenses including toric lenses. For the most part, improved conformal tools are progressively incremented in diopter ranges so that the tool does not accurately conform progressively at any position of a lens contour. Thus, the fining/polishing process can adversely effect the accuracy of the lens geometry.

One presently known conformal tool applies air pressure under the control of the operator in the bladder of the conformal tool to control the degree of conformance to the lens. However, the use of air pressure or hydraulic pressure in the tool bladder under operator control introduces considerable inaccuracy into the system. In addition, the face of the tool tends to buckle and lose its integrity with the lens surface, introducing further error into the system.

Other recently developed conformal tools use a conformable filler in a pliant casing to contour the tool to the lens. Such tools eliminate the introduction of error due to the operator's subjective introduction of air into the bladder. However, all the fluids or particles of the conformable filler are free to shift in any direction in response to the many forces exerted on the tool including the rotational motion of the tool and the axial displacement of the tool as well as the contour of the lens. Consequently, not all fluid or particle movement is directed toward achieving conformance.

It is, therefore, an object of this invention to provide a conformal tool for fining/polishing ophthalmic lenses affording unidirectional movement of the conformal medium toward the lens. Another object of this invention is to provide a conformal tool for fining/polishing ophthalmic lenses which restricts movement of the conformal medium in any direction other than toward the lens. Still another object of this invention is to provide a conformal tool for fining/polishing ophthalmic lenses which transforms multidirectional pneumatic pressure into unidirectional mechanical force to achieve conformance of a diaphragm to a lens. It is also an object of this invention to provide a conformal tool for fining/polishing ophthalmic lenses which uses a diaphragm to transfer multidirectional pneumatic pressure to a cluster of rods unidirectionally arranged in slidable tangential contact with each other. A further object of this invention is to provide a conformal tool for fining/polishing ophthalmic lenses which is capable of fining and polishing any lens within the range of plano to 14 diopters. Another object of this invention is to provide a conformal tool for fining/polishing ophthalmic lenses which is capable of fining and polishing any lens within a range of plano to 14 diopters with at least the added capability of 4 diopters of cylinder. Yet another object of this invention is to provide a conformal tool for fining/polishing ophthalmic lenses which is usable for both fining and polishing.

SUMMARY OF THE INVENTION

In accordance with the invention, a tool is provided which has an outer shell or housing containing a bundle of rods of a plastic material, all of the rods being of equal length. The clustered rods are individually free to move up and down unidirectionally along their vertical axes but are constrained against relative motion in any other direction. Preferably, the rods are encased in an open ended tubular housing, the open ends being closed by two resiliently elastic diaphragms, one located at each end of the housing. An air chamber at one end of the housing receives compressed air and exerts pressure upon a first of the diaphragms. The first diaphragm in turn exerts pressure upon the abutting ends of the rods, forcing the opposite ends of the rods against the second diaphragm which in turn stretches to move with the rods. The second diaphragm, or a conformal pad applied to it, contacts the surface of the lens during fining and polishing. The second diaphragm is stretched by the unidirectionally driven rods to provide a sponge-like pad which conforms to the surface of the lens. As the diaphragm is moved over the surface of the lens, it complies vertically with the change in the lens surface contour immediately and appears to "flow" over the lens surface. However, the clustered rods simultaneously resist changes that are made in a horizontal mode, thus presenting a hard surface to the lens and allowing the abrasives on the conformal pads applied to the second diaphragm to have a positive effect while being moved.

The tubular housing is typically, but not necessarily, interiorly cylindrical. In a specially preferred embodiment, the rods are held in an hexagonal bundle by six identical isometric trapezoidal plates girded by a pair of O-rings seated in slots at the plate junctions. The O-rings are slightly compressed between the housing inner wall and the plates to secure the hexagonal assembly within the cylindrical housing.

BRIEF DESCRIPTION OF THE DRAWINGS

Other objects and advantages of the invention will become apparent upon reading the following detailed description and upon reference to the drawings in which.

Figure 1:
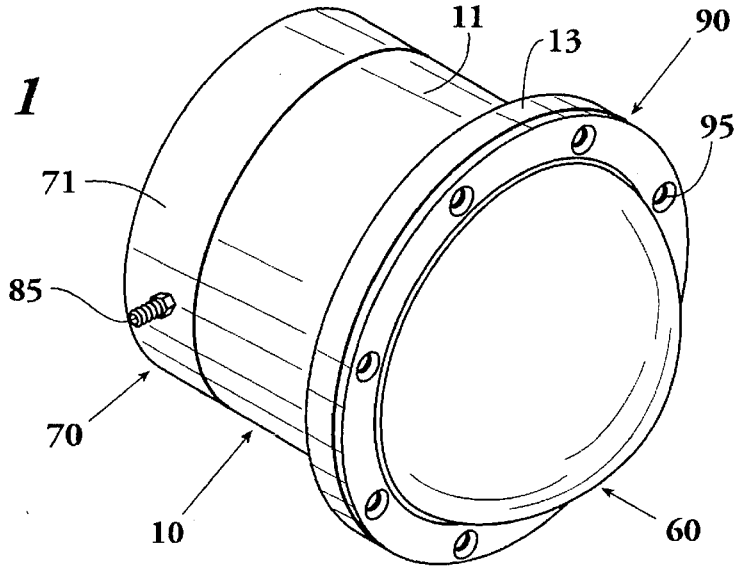
FIG. 1 is a perspective view of a preferred embodiment of the pneumatically assisted unidirectional conformal tool in a condition in which sufficient pneumatic pressure has been applied to the first diaphragm to unidirectionally shift the rods and stretch the second diaphragm toward conformal contact with the lens.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Looking at the drawings, the components of a preferred embodiment of the pneumatically assisted unidirectional conformal tool include a housing 10, containing a cluster of rods 30 between a top diaphragm 50 and a bottom diaphragm 60. The top diaphragm 50 is sandwiched against the housing 10 by a pneumatic cap 70 and the bottom diaphragm 60 is sandwiched against the housing 10 by a bottom ring 90.

As shown, the housing 10 consists of a cylindrical wall 11 having an annular flange 13 about its lower end in a tophat-like configuration. An annular bevel 15 is provided along the inner periphery of the upper portion of the cylindrical wall 11. A plurality of tap holes 17 are provided into the top face of the cylindrical wall 11 outside of the bevel 15, the tap holes 17 extending longitudinally into the cylindrical wall 11 at intervals about its circumference. As shown, eight tap holes 17 are equally spaced in the top of the cylindrical wall 11. Another set of tap holes 19 are provided in the annular flange 13, the lower tap holes 19 extending longitudinally into the flange 13 at intervals circumferentially spaced about the flange 13. As shown, eight lower tap holes 19 are equally spaced apart in the flange 13. The outer beveled diameter 21 of the cylindrical wall 11 is greater than its inner wall diameter 23 and less than the diameter 25 along which the lower tap holes 17 are arranged. Alternatively, the thickness of the cylindrical wall 11 could be increased to be substantially equal to the outer diameter of the flange 13 so that the tap holes 13 and 17 can be longitudinally aligned and drilled as a common hole throughout the length of the cylindrical wall 11. Preferably, the housing 10 will be made of plastic material, perhaps by injection molding.

The housing 10 contains a cluster of rods 30 with the length 31 of each of the rods of the cluster 30 being equal to the length of the housing 10. Typically, the length 31 will be in the range of 3" and the diameter 33 of each of the rods in the cluster 30 will be approximately 0.125". However, the diameter of the rods of the cluster 30 may be varied considerably. Smaller diameter rods will provide greater contour accuracy while larger diameter rods will provide a longer lasting tool. Preferably, the bottom ends 37 of the individual rods of the cluster 30 will be rounded to further enhance contour accuracy. A lubricant 39, such as oil, water or other mildly lubricating substance, may be provided in the housing 10 to assure that the rods of the cluster 30 do not bind against each other or against the inner surface of the cylindrical wall 11 as the rods move unidirectionally in the housing 10. The cluster of rods 30 will include a sufficient number of rods to restrict non-longitudinal movement. Preferably, the rods of the cluster 30 will be made of a plastic material, preferably Delrin.

The cluster of rods 30 is maintained within the housing 10 by a top diaphragm 50 and a bottom diaphragm 60. The top diaphragm 50 has a diameter 51 substantially equal to the outer diameter of the cylindrical wall 11 and is provided with apertures 53 which align with the upper tap holes 17 in the cylindrical wall 11. The bottom diaphragm 60 has a diameter 61 which is substantially equal to the outer diameter of the flange 13 and has a plurality of apertures 63 aligned with the lower tap holes 19 in the flange 13. The diaphragms 50 and 60 are preferably made of a silicon elastomer material which, in an unstressed condition, will lie in a planar relationship across the upper and lower ends of the housing 10.

The upper diaphragm 50 is sandwiched in place against the upper face of the housing 10 by a pneumatic cap 70 which consists essentially of a cylindrical body 71 having an outer diameter substantially equal to the outer diameter of the cylindrical wall 11 of the housing 10. A socket 73 is provided in the upper face of the pneumatic cap 70 for coupling the tool to the chuck of a surface enhancing machine (not shown). An annular air chamber or passage 75 is provided in the lower face of the cap 70 and defines an interior central land 77. A space 99 extends between the land 77 and the upper diaphragm 50 when the cap 70 is seated on the diaphragm 50. Apertures 81 are provided longitudinally in the periphery of the cap 70 which align with the upper tap holes 17 in the housing 10. The diameter 83 of the air chamber or passage 75 is preferably greater than the inner diameter 23 of the housing 10 and less than the outer diameter 21 of the bevel 15 in the housing 10. An air inlet port 85 is provided through the wall of the cap 70 to provide pneumatic access to the annular air chamber or passage 75. Preferably, the caps 70 will be made of plastic, perhaps injection molded.

The lower diaphragm 60 is sandwiched against the bottom face of the housing 10 by a bottom ring 90 of outer diameter substantially equal to the outer diameter of the flange 13 of the housing 10. Preferably, the upper inner periphery of the ring 90 will have an annular bevel 91. The inner diameter 93 of the ring 90 is substantially greater than the inner diameter 23 of the housing 10. A plurality of apertures 95 are circumferentially spaced and longitudinally aligned through the ring 90 in alignment with the lower tap holes 19 in the flange 13 of the housing 10. Preferably, the bottom ring 90 will be of plastic, perhaps injection molded.

In assembling the tool, the lower diaphragm 60 is placed in planar relationship over the lower end of the housing 10 with the lower tap holes 19 of the housing 10 aligned with the apertures 63 in the ring 60. The bottom ring 90 is then laid over the bottom diaphragm 60 with its apertures 81 aligned with the apertures 63 in the bottom diaphragm 60. Screws (not shown) are then tightened through the bottom ring apertures 95 into the housing tap holes 19 to firmly clamp the bottom diaphragm 60 between the housing 10 and the bottom ring 90. A rod cluster 30 of suitable diameter 35 to maintain the rods in longitudinal alignment within the housing 10 is dropped into the housing 10 through its open upper end. A small amount of lubricant 39 is also introduced into the housing 10 to lubricate the contacting surfaces of the rods with each other and with the inner wall of the housing 10. The top diaphragm 50 is then laid in planar relationship over the upper end of the housing 10 with the diaphragm apertures 63 aligned with the upper housing tap holes 17. The cap 70 is then laid over the top diaphragm 50 with its apertures 81 aligned with the housing upper tap holes 17. Screws (not shown) are thus tightened through the cap apertures 81 into the housing upper tap holes 17 to clamp the top diaphragm 50 between the housing 10 and the cap 70. The completed tool can then be mounted for operation on a surface enhancing machine (not shown) by coupling the chuck (not shown) of the machine with the chuck socket 73 in the tool. A pad (not shown) having the desired abrasive quality can then be overlaid on the lower diaphragm 60 for contact with the lens (not shown) to be fined or polished.

In operation, with the tool mounted on the machine, air under pressure is admitted into the chamber 75 in the cap 70 through the air inlet passage 85. Typically, the air pressure in an approximately 3" diameter housing will be in a range of 2 to 10 psi and preferably approximately 5 to 6 psi. The air pressure in the chamber 75 causes the top diaphragm 50 to be depressed against the rod cluster 30. The multidirectional motion of the top diaphragm 50 in response to the pressure in the chamber 75 causes the diaphragm 50 to resiliently distort, imparting a unidirectional downward motion to the rods in the cluster 30. As shown, the bevel 15 in the housing 10 permits the distortion of the top diaphragm 50 to be more evenly distributed across the top of the rods and also prevents damage to the top diaphragm 50 resulting from an otherwise square or sharp corner at the contact point of the top diaphragm 50 with the housing 10. Similarly, as the rods of the cluster 30 are downwardly driven by the upper or top diaphragm 50, the lower or bottom diaphragm 60 is distorted by the unidirectional force applied by the rods in the cluster 30. Conformance of the bottom diaphragm 60 to the bottom ends of the rods in the cluster 30 is facilitated by the greater inner diameter 93 of the bottom ring 90. The bottom ring bevel 91 further facilitates this conformance as well as prevents sharp edges of the ring 90 from damaging the bottom diaphragm 60.

The air pressure applied to the chamber 75 in the cap 70 is selected or regulated to suit the particular application of the tool. The diaphragm material should insure that lubricants and air do not escape their appropriate chambers. If the depth of the space 79 between the cap land 77 and the planar surface of the top diaphragm 50 is sufficient, the tool can be used to fine or polish concave or convex lenses by appropriate selection of the air pressure in the chamber, the top and bottom diaphragms operating in opposite fashion to that described herein to fine or polish a convex lens.

Figure 4:
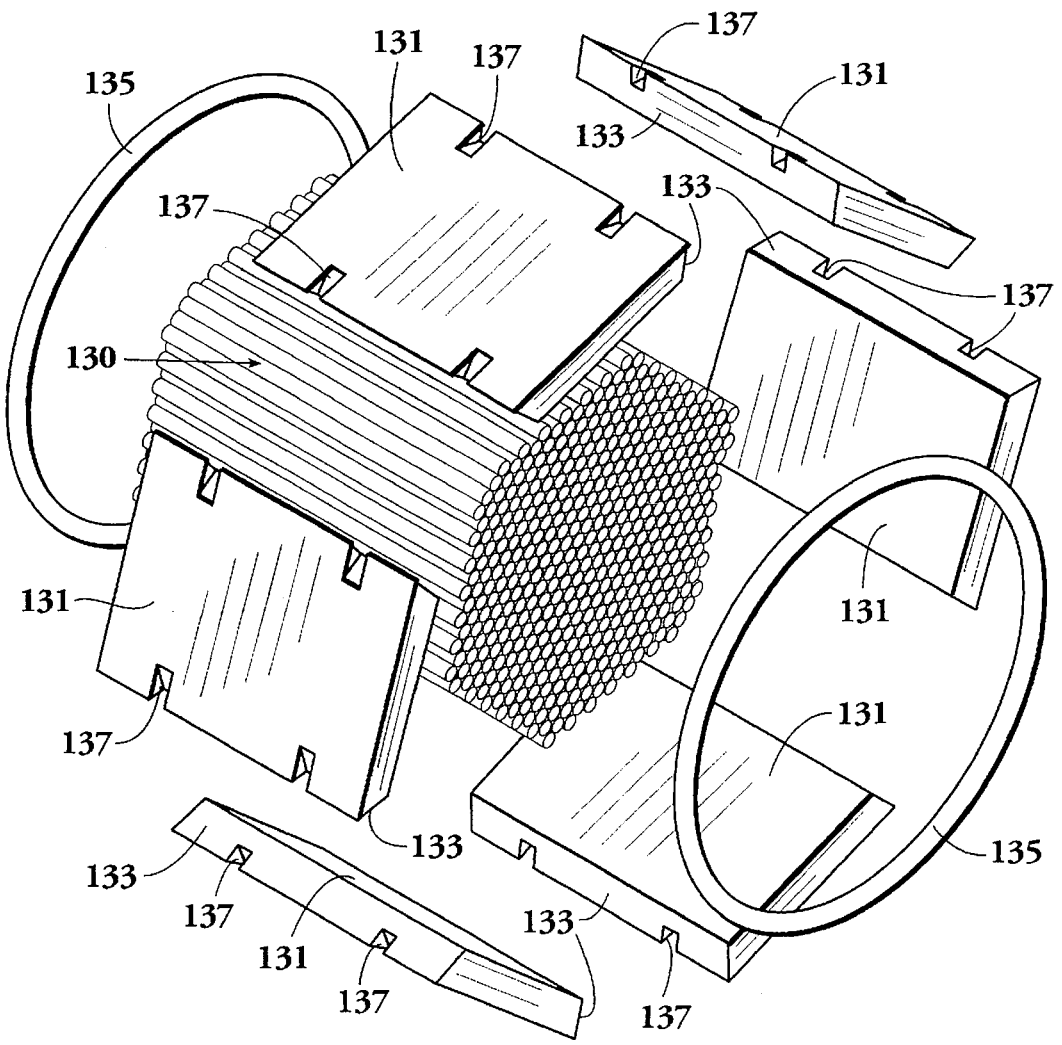
FIG. 4 is a perspective assembly view of the components of a specially preferred embodiment of a rod bundle for use with a pneumatically assisted unidirectional conformal tool such as the tool of FIG. 1.
Figure 2:
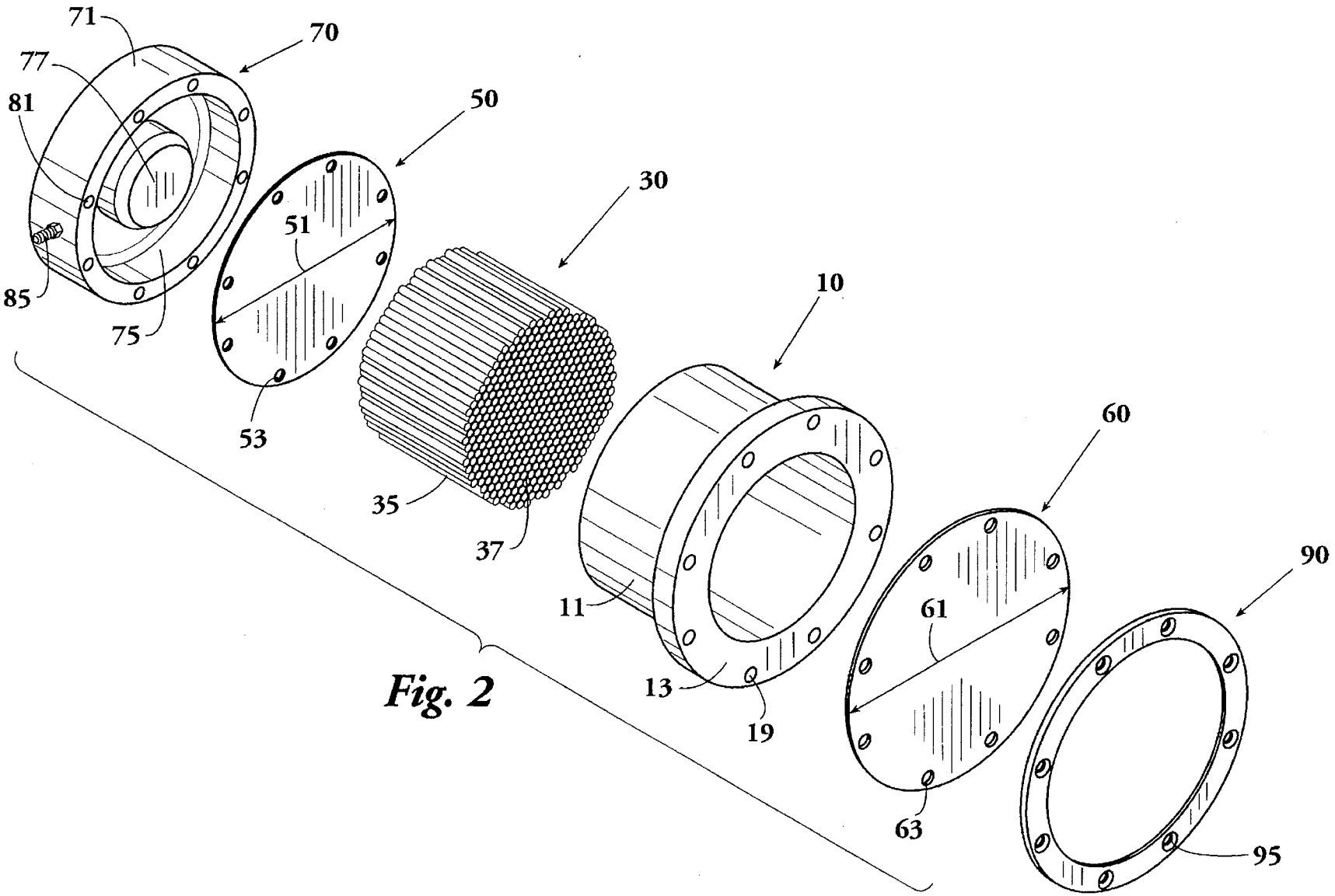
FIG. 2 is a perspective assembly view of the components of the pneumatically assisted unidirectional conformal tool of FIG. 1.
Figure 3:
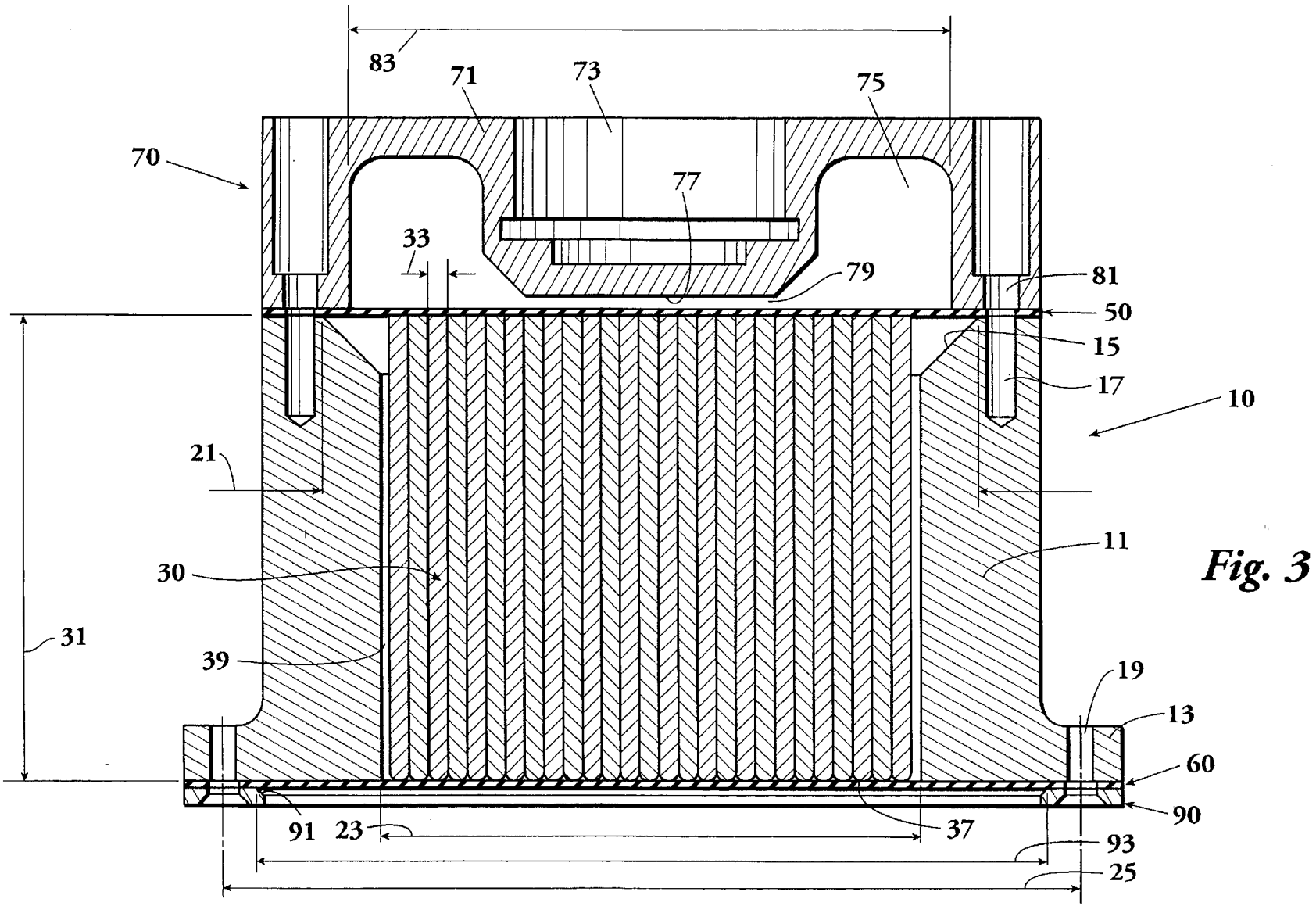
FIG. 3 is a diametric cross-section of the pneumatically assisted unidirectional conformal tool of FIG. 1.
Figure 5:
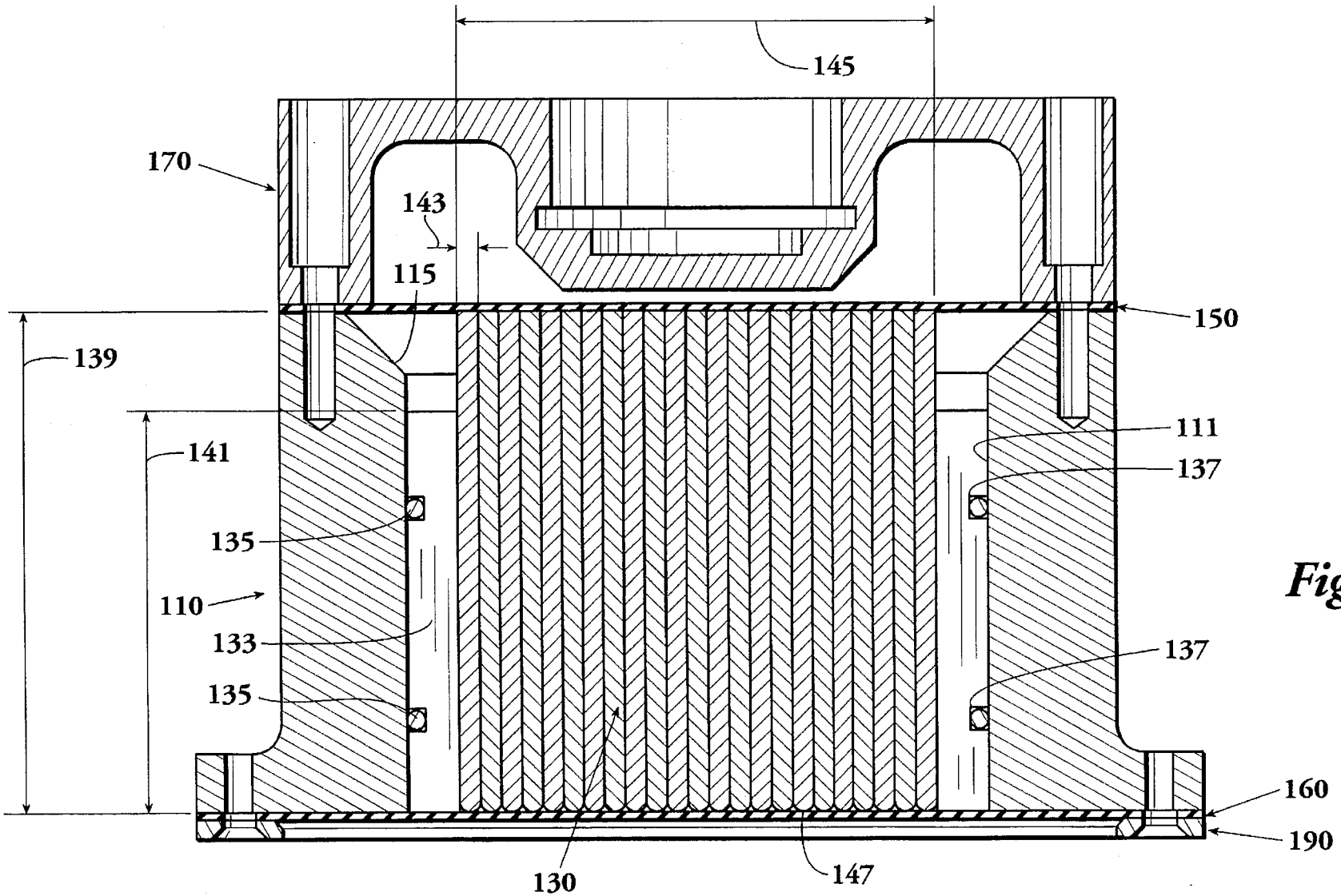
FIG. 5 is a diametric cross-section of the bundle of FIG. 4 loaded into the housing of a conformal tool otherwise identical to the tool of FIG. 1.

In a specially preferred embodiment of the pneumatically assisted unidirectional conformal tool, an hexagonal rod cluster 130 such as that illustrated in FIG. 4 is loaded into a tool having a housing 110, a top diaphragm 150, a bottom diaphragm 160, a pneumatic cap 170 and a bottom ring 190 which are substantially the same as their corresponding components in the tool described in relation to FIG. 1. The rods are held in the hexagonal cluster 130 by six identical plates 141 of isometric trapezoidal cross-section. The beveled side edges 133 of the plates 131 are held in serial abutment by a pair of O-rings 145 which are stretchable to gird the plates 131 and are seated in slots 137 in the plates 131 which mate at the serial junction points. As can best be seen in FIG. 5, the length 139 of the rods is substantially equal to the length of the housing 110 while the length 141 of the plates 131 is less than the length of the interior wall 111 of the housing 110 from its bottom to its upper annular bevel 115. Preferably, the rods of the cluster 130 will each have a diameter 143 of approximately 0.125 inches, though the diameter of the rods may be varied considerably, and the diameter 145 of the hexagonal cluster 130 will be such as to restrict non-longitudinal movement of the undivided rods. It is also preferred that the bottom ends 147 of the rods will be rounded to further enhance contour accuracy. Also as can be seen in FIG. 5, the O-rings 135 are compressed between the inner wall 111 of the housing 110 and the trapezoidal plates 131 at the serial junction points of the plates 131 so as to firmly seat the hexagonal plate assembly in the housing 110.

The hexagonal cluster configuration is preferred because it enhances the restriction of non-vertical motion of the rods within the assembly. However, other satisfactory cluster configurations can be achieved by adaptation of a suitable shell interiorly defining the contour of the cluster and exteriorly conformed to the interior of the housing. Preferably, the shell components used are of plastic material, perhaps injection molded. The O-rings are preferably Neoprene. Alternatively, the interior of the housing itself can be contoured to provide the desired cluster cross-section without use of a special shell.

Thus, it is apparent that there has been provided, in accordance with the invention, a pneumatically assisted unidirectional conformal tool that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A tool for polishing/fining a lens comprising:

a pair of oppositely disposed planar resiliently elastic diaphragms;

a plurality of rods, each rod of said plurality of rods extending longitudinally from one said diaphragm to another said diaphragm; and means for holding said plurality of rods in sliding abutment in a cluster between said diaphragms, whereby continuous distorting force applied longitudinally to an exterior surface of said one diaphragm is transmitted by longitudinal displacement among said cluster of rods to an interior surface of said another diaphragm to cause said another diaphragm to dynamically comply to a surface of a lens disposed across said another diaphragm as said another diaphragm and said lens are relatively laterally displaced.

2. A tool according to claim 1 further comprising means for applying pneumatic force to said exterior surface of said one diaphragm.

3. A tool for polishing/fining a lens comprising:

a housing open at planar ends thereof;

a cluster of rods longitudinally aligned in sliding abutment within said housing, each rod of said cluster extending from one of said planar ends to another of said planar ends; and a pair of resiliently elastic diaphragms, one fixed across each of said planar ends, whereby continuous distorting force applied longitudinally to an exterior surface of one of said diaphragms is transmitted by longitudinal displacement among said cluster of rods to an interior surface of another of said diaphragms to cause said another diaphragm to dynamically comply to a surface of a lens disposed across said another diaphragm as said another diaphragm and said lens are relatively laterally displaced.

4. A tool according to claim 3 further comprising a cap fixed to said housing and defining a pneumatic chamber between said exterior surface of said one diaphragm and an interior wall of said cap and a passage through said cap for admitting air under pressure into said chamber.

5. A tool for polishing/fining a lens comprising:

a housing having a right cylindrical interior open at first and second planar ends thereof;

a cylindrical cluster of rods longitudinally aligned in sliding abutment within said housing, each rod of said cluster extending from said first planar end to said second planar end of said housing interior; and first and second resiliently elastic diaphragms fixed across said first and second planar ends, respectively, whereby continuous distorting force applied longitudinally to an exterior surface said first diaphragm is transmitted by longitudinal displacement among said cluster of rods to an interior surface of said second diaphragm to cause said second diaphragm to dynamically comply to a surface of a lens disposed across said second diaphragm as said second diaphragm and said lens are relatively laterally displaced.

6. A tool according to claim 5 further comprising a cap fixed to said housing and defining a cylindrical pneumatic chamber longitudinally aligned between said exterior surface of said first diaphragm and an interior wall of said cap and a passage through said cap for admitting air under pressure into said pneumatic chamber.

7. A tool according to claim 6, said pneumatic chamber being longitudinally aligned with said housing interior and having a diameter greater than a diameter of said housing interior.

8. A tool according to claim 7, said housing having an annular chamfer about said first planar end thereof.

9. A tool according to claim 8, said chamfer having a diameter at said first planar end greater than said pneumatic chamber chamfer diameter.

10. A tool according to claim 9, said second diaphragm being secured against said second planar end along an annular portion of inner diameter substantially greater than said housing interior diameter.

11. A tool according to claim 10, said annular portion inner diameter being greater than said pneumatic chamber chamfer diameter.

12. A tool for polishing/fining a lens comprising:

a housing having a right cylindrical interior open at first and second planar ends thereof;

a cylindrical cluster of rods longitudinally aligned in sliding abutment within said housing, each rod of said cluster extending from said first planar end to said second planar end of said housing interior;

a first resiliently elastic diaphragm extending across said first planar end;

a cap having a rim disposed against an exterior perimeter of said first diaphragm, said rim defining a cylindrical pneumatic chamber longitudinally aligned between an exterior surface of said first diaphragm and an interior wall of said cap and having a passage therethrough for admitting air under pressure into said chamber;

a second resiliently elastic diaphragm extending across said second planar end;

a ring disposed against an exterior perimeter of said second diaphragm; and means for securing said cap and said ring to said housing with said diaphragms therebetween whereby pneumatic distortion of said first diaphragm is transmitted by longitudinal displacement among said cluster of rods to an interior surface of said second diaphragm to cause said second diaphragm to dynamically comply to a surface of a lens disposed across said second diaphragm as said second diaphragm and said lens are relatively laterally displaced.

13. A tool according to claim 12, said pneumatic chamber being longitudinally aligned with said housing interior and having a diameter greater than a diameter of said housing interior.

14. A tool according to claim 13, said housing having an annular chamfer about said first planar end thereof.

15. A tool according to claim 14, said chamfer having a diameter at said first planar end greater than said pneumatic chamber chamfer diameter.

16. A tool according to claim 15, said having an inner diameter substantially greater than said housing interior diameter.

17. A tool according to claim 16, said ring inner diameter being greater than said pneumatic chamber chamfer diameter.

18. A tool according to claim 17, said ring inner diameter having an annular chamfer along an interior face thereof.

19. A tool according to claim 18, said ring inner diameter being approximately equal to an outer diameter of said housing and said housing having an annular flange about said second planar end for alignment with said ring.

20. A tool according to claim 19, said cap being adapted for mounting on a fining/polishing machine chuck.

21. A tool for polishing/fining a lens comprising:

a housing having a right hexagonal interior open at first and second planar ends thereof;

an hexagonal cluster of rods longitudinally aligned in sliding abutment within said housing, each rod of said cluster extending from said first planar end to said second planar end of said housing interior; and first and second resiliently elastic diaphragms fixed across said first and second planar ends, respectively, whereby continuous distorting force applied longitudinally to an exterior surface said first diaphragm is transmitted by longitudinal displacement among said cluster of rods to an interior surface of said second diaphragm to cause said second diaphragm to dynamically comply to a surface of a lens disposed across said second diaphragm as said second diaphragm and said lens are relatively laterally displaced.

22. A tool for polishing/fining a lens comprising:

a housing having a right cylindrical interior open at first and second planar ends thereof;

an hexagonal cluster of rods longitudinally aligned in sliding abutment, each rod of said cluster extending from said first planar end to said second planar end of said housing interior;

means girding said hexagonal cluster and contacting said housing interior for holding said cluster in longitudinal alignment within said housing; and first and second resiliently elastic diaphragms fixed across said first and second planar ends, respectively, whereby continuous distorting force applied longitudinally to an exterior surface said first diaphragm is transmitted by longitudinal displacement among said cluster of rods to an interior surface of said second diaphragm to cause said second diaphragm to dynamically comply to a surface of a lens disposed across said second diaphragm as said second diaphragm and said lens are relatively laterally displaced.

23. A tool according to claim 22, said girding and contacting means comprising:

six serially abutting substantially identical plates of isometric trapezoidal cross-section; and means for securing said plates in serial abutment.

24. A tool according to claim 23, said securing means comprising at least one resiliently elastic means stretched about said serially abutting plates.

25. A tool according to claim 24 further comprising at least one slot in an outer surface of at least one of said plates, said resiliently elastic means being seated therein.

* * * * *